US008382499B2

(12) United States Patent
Oketani et al.

(10) Patent No.: US 8,382,499 B2
(45) **Date of Patent: *Feb. 26, 2013**

(54) POWER CONNECTION APPARATUS

(75) Inventors: Tetsuya Oketani, Ota (JP); Masahiko Nagatake, Gunma-ken (JP); Satoshi Ishikawa, Gunma-ken (JP); Kenji Maru, Gunma-ken (JP)

(73) Assignee: SANYO Electric Co., Ltd., Moriguchi (JP)

( * ) Notice: Subject to any disclaimer, the term of this patent is extended or adjusted under 35 U.S.C. 154(b) by 176 days.

This patent is subject to a terminal disclaimer.

(21) Appl. No.: 12/826,119

(22) Filed: Jun. 29, 2010

(65) Prior Publication Data

US 2011/0028014 A1 Feb. 3, 2011

(30) Foreign Application Priority Data

Jul. 31, 2009 (JP) ..... 2009-179029

(51) Int. Cl.
*H01R 13/62* (2006.01)

(52) U.S. Cl. ..... 439/160; 439/149; 439/150

(58) Field of Classification Search ..... 439/160, 439/149, 150, 125, 127, 128, 159, 310
See application file for complete search history.

(56) References Cited

U.S. PATENT DOCUMENTS

| | | | | |
|---|---|---|---|---|
| 3,801,757 | A * | 4/1974 | Carissimi et al. | 200/50.28 |
| 5,679,014 | A * | 10/1997 | Lan-Jen | 439/160 |
| 7,473,113 | B2 * | 1/2009 | Koda | 439/157 |
| 7,883,347 | B1 * | 2/2011 | Oketani et al. | 439/157 |
| 2007/0268709 | A1 * | 11/2007 | Oketani et al. | 362/378 |

FOREIGN PATENT DOCUMENTS

JP 11-273775 A 10/1999

* cited by examiner

*Primary Examiner* — Vanessa Girardi
(74) *Attorney, Agent, or Firm* — Westerman, Hattori, Daniels & Adrian LLP

(57) ABSTRACT

There is disclosed a power connection apparatus which can secure connection between a power socket and a power plug with a simple constitution and which can simplify the connecting operation properties thereof. A handle rotatably attached to the power plug having terminals includes engaging claw disengageably engaged with engagement portion of the power socket having an electrode portion, an abutment portion which abuts on the power socket, and a grip portion. In a state where the handle is rotated to such an angle that the handle is at substantially right angles to the power socket, the abutment portion abuts on the power socket, thereby releasing connection between the electrode portion and the terminals or the like.

4 Claims, 14 Drawing Sheets

POWER CONNECTION APPARATUS

BACKGROUND OF THE INVENTION

The present invention relates to a power connection apparatus for supplying a power to, for example, an illuminative lamp or the like in a showcase.

In general, a showcase or the like is provided with a power connection apparatus constituted of a power socket connected to the inside of a chamber of a main body and a power plug plugged in this power socket to supply a power to an illuminative lamp or the like. In a conventional power connection apparatus disclosed in, for example, Japanese Patent Application Laid-Open No. 11-273775 (the patent document), a power socket is provided with a recess portion in which an electrode portion is disposed. This electrode portion is provided with plug-in ports for a power source. A power plug comprises a main body and a cylindrical portion connected to an illuminative lamp or the like via a wiring line, and terminals are provided on a bottom portion inside the cylindrical portion. In consequence, the power plug is plugged in the electrode portion of the power socket by plugging the terminals of the power plug in the power source plug-in ports of the power socket.

When the power connection apparatus is used in a low temperature showcase, the power plug serves for each of illuminative lamps and the like provided under front ends of a plurality of shelf devices arranged in the chamber. In the case of layout change or the like in the chamber, the arrangement positions of the shelf devices are changed, and accordingly, the power socket to be connected to the power plug is changed.

On the other hand, when the power connection apparatus is provided on a back surface in the chamber which becomes a low temperature in the showcase, humidity generated in the chamber easily invades each connecting portion between the electrode portion and each terminal. The invasion of the humidity causes electrical leakage or incurs the rusting of the terminals and the like. Moreover, frost is generated between the power plug and the power socket, which causes a problem that with the growth of the frost, a force is applied in a direction in which the power plug is detached from the power socket, and the power plug drops down.

To solve the problem, a preventive structure is employed in the connecting portion between the power plug and the power socket. However, this obstructs the attachment/detachment operation of the power plug and the power socket. Furthermore, in a low temperature environment, air in the power socket contracts, and hence the attachment/detachment operation further becomes difficult.

Therefore, to secure the connection between the power plug and the power socket, there has heretofore been developed a constitution in which engagement portions are provided on a power socket side, a handle rotatable at one end thereof is provided on a power plug side, and the handle has the other end provided with engaging claws disengageably engaged with the engagement portions on the power socket side.

In the above conventional constitution, even when the engaging claws of the power plug are not engaged with the engagement portions of the power socket in a state where the power plug is pressed onto the power socket, the terminals of the power plug have been brought into contact with the electrode portion of the power socket. Therefore, an operator discontinues the connection between the power plug and the power socket sometimes while keeping the state where the power plug is pressed onto the power socket and the engaging claws are not engaged with the engagement portions.

Even in this case, the terminals come in contact with the electrode portion, and hence the power is supplied to the illuminative lamp or the like provided with the power plug. However, when the power plug is left to stand in this state, the power plug easily drops down from the power socket, and in addition to the discontinuance of the power supply to the illuminative lamp or the like, water sticks to the terminals of the power plug or the electrode portion of the socket owing to the humidity in the chamber, which has been the cause for the electrical leakage or the rusting.

The present invention has been developed to solve the conventional technical problem, and an object thereof is to provide a power connection apparatus which can secure connection between a power socket and a power plug with a simple constitution and which can simplify the connecting operation properties thereof.

SUMMARY OF THE INVENTION

To achieve the above object, according to a first aspect of the present invention, there is provided a power connection apparatus which is constituted of a power socket including an electrode portion and a power plug including terminals electrically connected to the electrode portion, the apparatus comprising: an engagement portion formed in the power socket; and a handle including a grip portion at one end thereof and an abutment portion at the other end, a pivoting portion positioned between the ends being rotatably attached to the power plug, characterized in that this handle includes engaging claw positioned at the pivoting portion or on the side of the grip portion from the pivoting portion to be disengageably engaged with the engagement portion of the power socket; when the handle is rotated in a direction in which the grip portion comes close to the power socket in a state where the terminals of the power plug are connected to the electrode portion of the power socket, the engaging claw disengageably engages with the engagement portion; when the handle is rotated as much as a predetermined angle or more from the state in a direction in which the grip portion comes away from the power socket, the engagement between the engaging claw and the engagement portion is released; and when the handle is further rotated to such an angle that the handle is at substantially right angles to the power socket, the abutment portion abuts on the power socket to release the connection between the electrode portion and the terminals.

A second aspect of the present invention is characterized in that in the above aspect of the invention, when the power plug is pressed onto the power socket in such a direction as to connect the terminals to the electrode portion in the state where the handle is rotated to such an angle that the handle is at substantially right angles to the power socket, the power plug is tentatively held by the power socket in a state where the abutment portion abuts on the power socket and the electrode portion is not connected to the terminals.

A third aspect of the present invention is characterized in that in the above aspects of the invention, the power plug fits into a seal member provided around the electrode portion, and is accordingly tentatively held by the power socket.

A fourth aspect of the present invention is characterized in that in the above aspects of the invention, the engaging claw can be disengageably engaged with the engagement portion, even when the power plug is pressed onto the power socket in such a direction as to connect the terminals to the electrode portion in a state where the engaging claw is directed to the power socket.

A fifth aspect of the present invention is characterized in that in the above aspects of the invention, the power socket comprises a drip-proof cover which covers the electrode portion in a state where the terminals of the power plug are not connected to the electrode portion.

A sixth aspect of the present invention is characterized in that in the above aspects of the invention, the power socket comprises a holding portion disposed beside the electrode portion to detachably hold the drip-proof cover, the drip-proof cover comprises a connection arm extended with an elasticity and having a tip rotatably supported by the power socket, and the connection arm projects from a position different from a position where a line connecting the tip to the center of the drip-proof cover intersects with this drip-proof cover, and extends toward the tip thereof.

According to the first aspect of the present invention, the power connection apparatus which is constituted of the power socket including the electrode portion and the power plug including the terminals electrically connected to the electrode portion comprises the engagement portion formed in the power socket; and the handle including the grip portion at the one end thereof and the abutment portion at the other end, the pivoting portion positioned between the ends being rotatably attached to the power plug. This handle includes the engaging claw positioned at the pivoting portion or on the side of the grip portion from the pivoting portion to be disengageably engaged with the engagement portion of the power socket. When the handle is rotated in the direction in which the grip portion comes close to the power socket in the state where the terminals of the power plug are connected to the electrode portion of the power socket, the engaging claw disengageably engages with the engagement portion; when the handle is rotated as much as a predetermined angle or more from the state in the direction in which the grip portion comes away from the power socket, the engagement between the engaging claw and the engagement portion is released; and when the handle is further rotated to such an angle that the handle is at substantially right angles to the power socket, the abutment portion abuts on the power socket to release the connection between the electrode portion and the terminals, whereby the terminals can easily be inserted into and disengaged from the electrode portion. In consequence, the deformation of the terminals can be prevented in advance.

Moreover, as in the above second aspect of the present invention, when the power plug is pressed onto the power socket in such a direction as to connect the terminals to the electrode portion in the state where the handle is rotated to such an angle that the handle is at substantially right angles to the power socket, the power plug is tentatively held by the power socket in the state where the abutment portion abuts on the power socket and the electrode portion is not connected to the terminals. Therefore, when the connection between the power plug and the power socket is discontinued in this state, the terminals and the electrode portion are left in a non-contact state, thereby allowing an operator to recognize that the connection is not sufficient. Furthermore, the operator can be urged to push the power plug into the power socket and to rotate the handle until the handle is substantially raised, thereby engaging the engaging claw of the power plug with the engagement portion of the power socket.

In consequence, the terminals are securely connected to the electrode portion to secure the engagement between the engaging claw and the engagement portion by the rotation of the handle, and it is possible to beforehand avoid a disadvantage that the power plug drops down from the power socket owing to, for example, the growth of frost between the power plug and the power socket or the like.

According to the above third aspect of the invention, in addition to the above aspects of the invention, the power plug fits into the seal member provided around the electrode portion, and is accordingly tentatively held by the power socket, whereby the power plug can tentatively be held by the power socket with a simple constitution. Moreover, a waterproof structure can be constituted, and it is possible to avoid a disadvantage that water sticks to the inside of the electrode portion or the terminals.

According to the above fourth aspect of the present invention, in addition to the above aspects of the invention, the engaging claw can be disengageably engaged with the engagement portion, even when the power plug is pressed onto the power socket in such a direction as to connect the terminals to the electrode portion in the state where the engaging claw is directed to the power socket, whereby the power plug can smoothly be attached to or detached from the power socket even in the state where the engaging claw is directed to the power socket. The improvement of convenience can be achieved.

According to the above fifth aspect of the invention, in addition to the above aspects of the invention, the power socket comprises the drip-proof cover which covers the electrode portion in the state where the terminals of the power plug are not connected to the electrode portion. Therefore, the drip-proof cover is attached to the electrode portion of the power socket in a state where the power plug is not connected to the power socket, which can suppress a disadvantage that the electrode portion of the power socket is exposed to cold air and dew condensation water invades the inside.

According to the sixth aspect of the invention, in addition to the above aspects of the invention, the power socket comprises the holding portion disposed beside the electrode portion to detachably hold the drip-proof cover. Therefore, also when the power plug is connected to the power socket and used, it is not necessary to separately store the only drip-proof cover, and it is possible to avoid a disadvantage that the drip-proof cover is lost.

Moreover, the drip-proof cover comprises the connection arm extended with the elasticity and having the tip rotatably supported by the power socket, and the connection arm projects from the position different from the position where the line connecting the tip to the center of the drip-proof cover intersects with this drip-proof cover, and extends toward the tip thereof. Therefore, the length of the connection arm can further be increased in a limited space, and the length required during the attachment/detachment to/from the electrode portion or the holding portion can be achieved owing to the elasticity of the connection arm.

In consequence, while the drip-proof cover is preferably pivotally supported by the power socket, the attachment/detachment operation properties of the electrode portion and the holding portion of the drip-proof cover can be improved.

DETAILED DESCRIPTION OF THE PREFERRED EMBODIMENT

Figure 1:
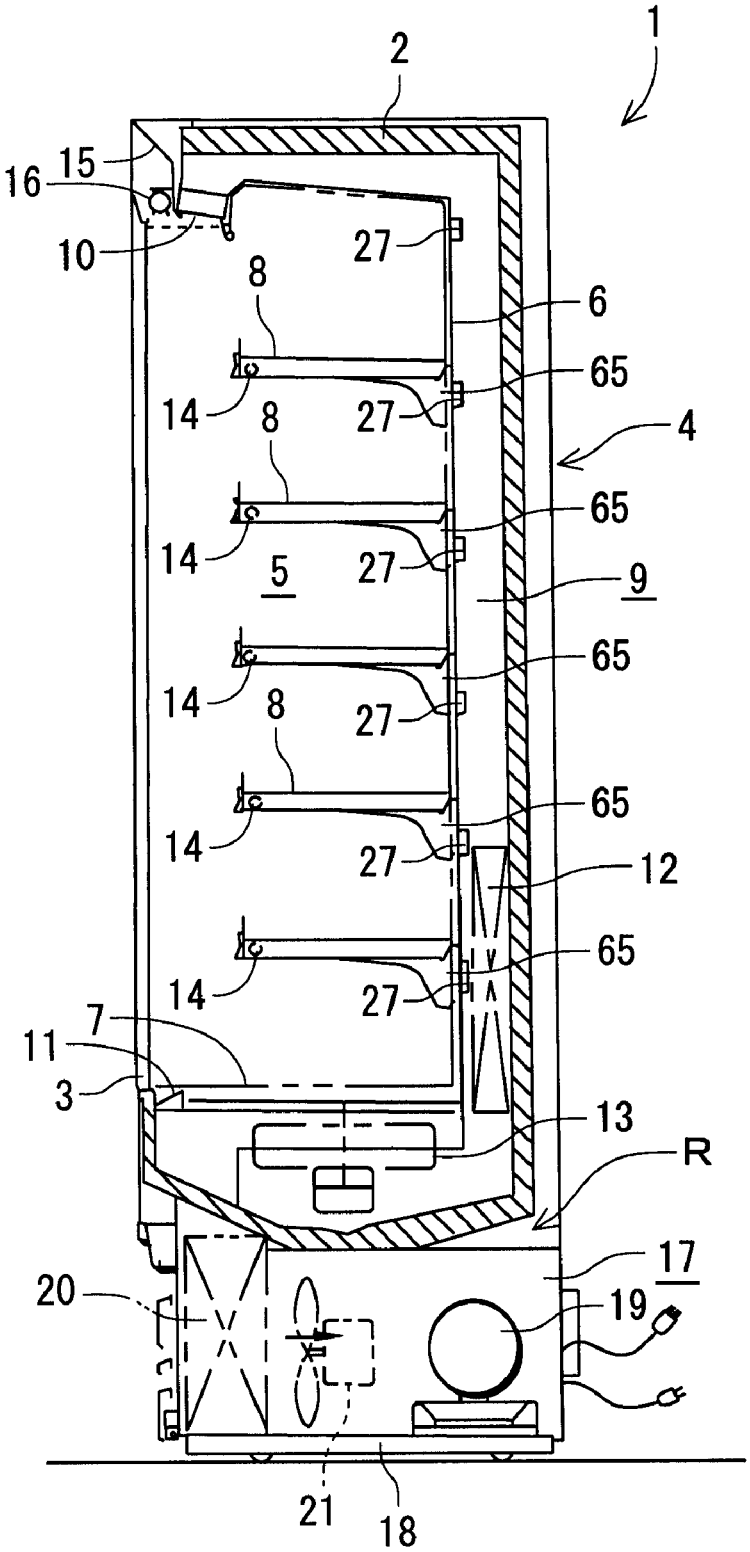
FIG. 1 is a schematic vertical side view of a low temperature showcase to which the present invention has been applied.

Hereinafter, a low temperature showcase 1 to which the present invention is applied will be described with reference to a schematic vertical side view of FIG. 1. The low temperature showcase 1 is installed in a store such as a supermarket or a convenience store, and side plates 3 and 3 are attached to both sides of an insulating wall 2 having a U-shaped cross section to constitute a main body 4. A partition plate 6 and a bottom plate 7 are attached inside the insulating wall 2 with a space therefrom, to constitute a display chamber 5 having an open front surface inside these components, and a series of cold air duct 9 is also interposed between these components and the insulating wall 2.

Furthermore, the duct 9 is connected to a discharge port 10 which opens at the upper edge of an opening of the display chamber 5 and to a suction port 11 which opens at the lower edge of the opening. Moreover, in the cold air duct 9 disposed along a back surface, a cooler 12 included in a cooling apparatus R is vertically provided, and in the cold air duct 9 under the bottom plate 7, a blower 13 is installed.

In the display chamber 5, a plurality of stages of shelves 8 . . . are vertically provided. Each of the shelves 8 is held by a support (not shown) provided in the display chamber 5 via brackets 65 and 65 attached on left and right sides. The support is provided with a plurality of vertically arranged engagement holes so that the attachment positions of the shelves 8 disposed on the support via engaging claws (not shown) formed at the rear ends of the brackets 65 can arbitrarily be changed. Moreover, on the lower surface of the shelf 8, there is detachably attached an illuminative lamp 14 for illuminating commodities on the lower shelf 8 and the front part of the display chamber 5.

Moreover, a canopy 15 is positioned before the discharge port 10 at the upper edge of the opening in the front surface of the insulating wall 2, and an illuminative lamp 16 for illuminating the inside of the display chamber 5 or the periphery of the display chamber 5 from the upside is attached to the lower portion of the canopy 15.

On the other hand, a machine chamber 17 is formed under the insulating wall 2, and a unit base 18 is provided in the machine chamber 17. Moreover, a compressor 19, a condenser 20 and a blower 21 for the condenser included in the cooling apparatus R are installed on the unit base 18 and arranged in the machine chamber 17.

According to the above constitution, when the blower 13 is operated, cold air subjected to heat exchange between the cold air and the cooler 12 is raised through the duct 9, and discharged into the display chamber 5 through the discharge port 10. Subsequently, the cold air sucked through the suction port 11 is again accelerated by the blower 13, and circulated through the display chamber 5, to cool the inside of the display chamber 5 to a predetermined temperature.

Figure 2:
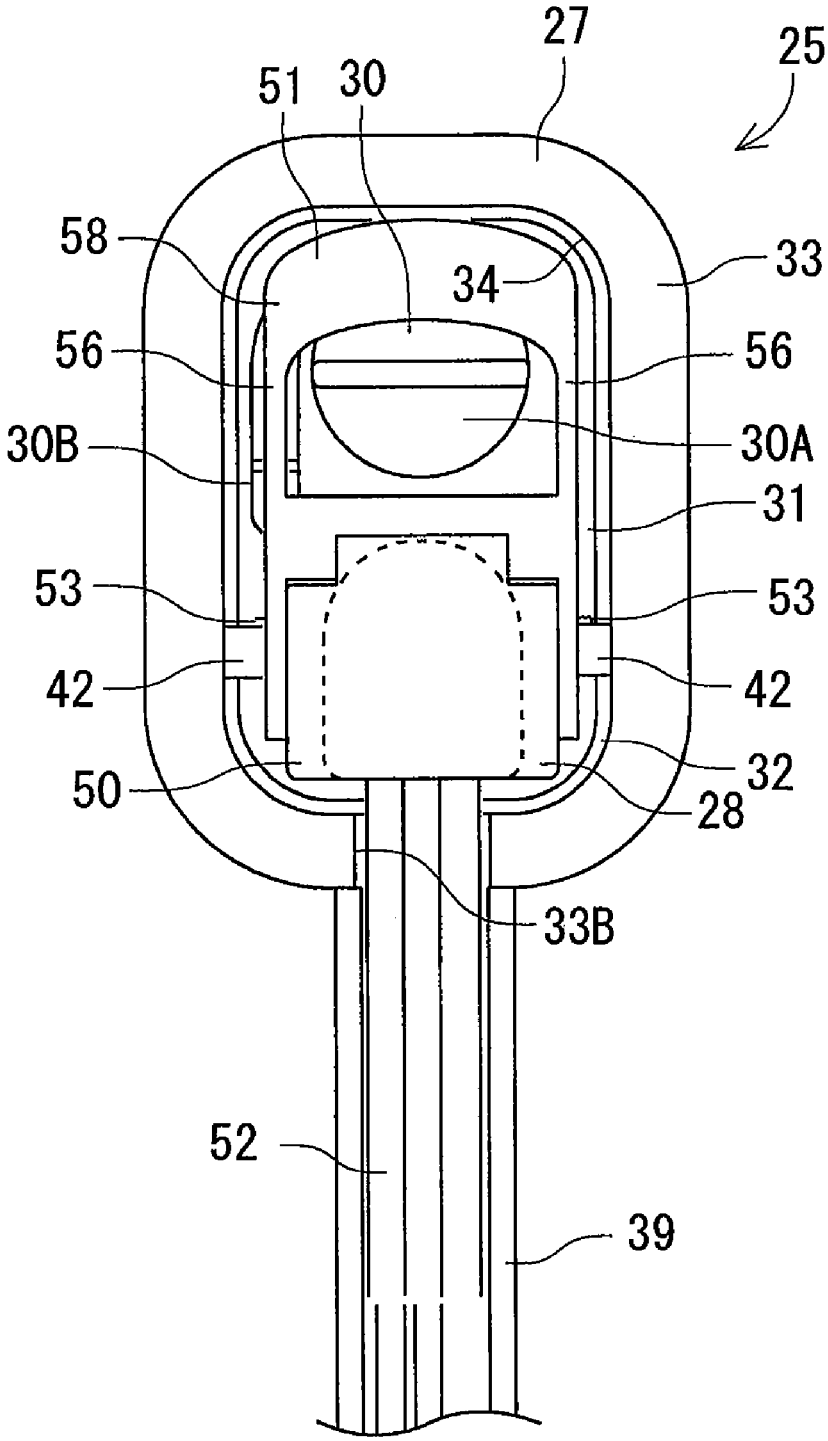
FIG. 2 is a front view of a power connection apparatus of the present invention.
Figure 3:
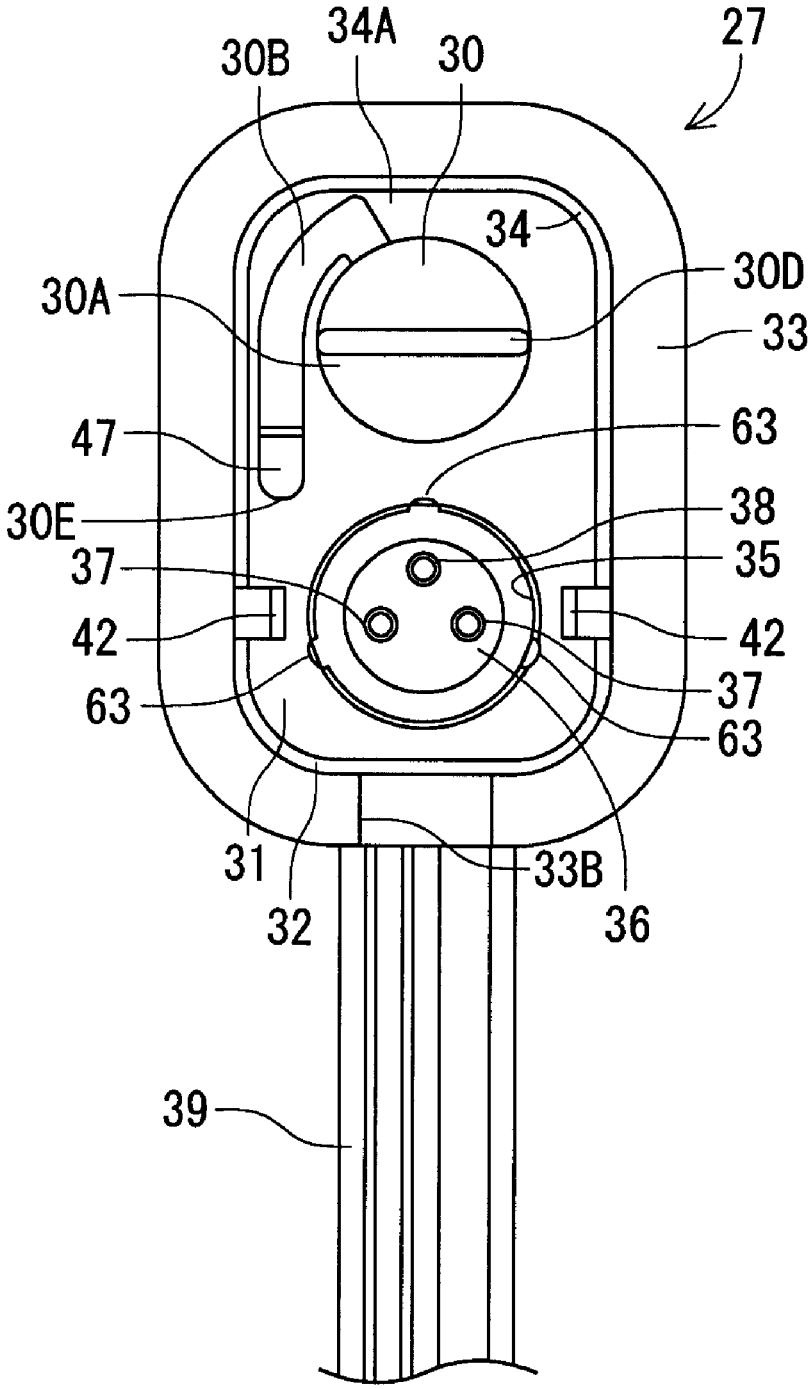
FIG. 3 is a front view of a power socket.
Figure 4:
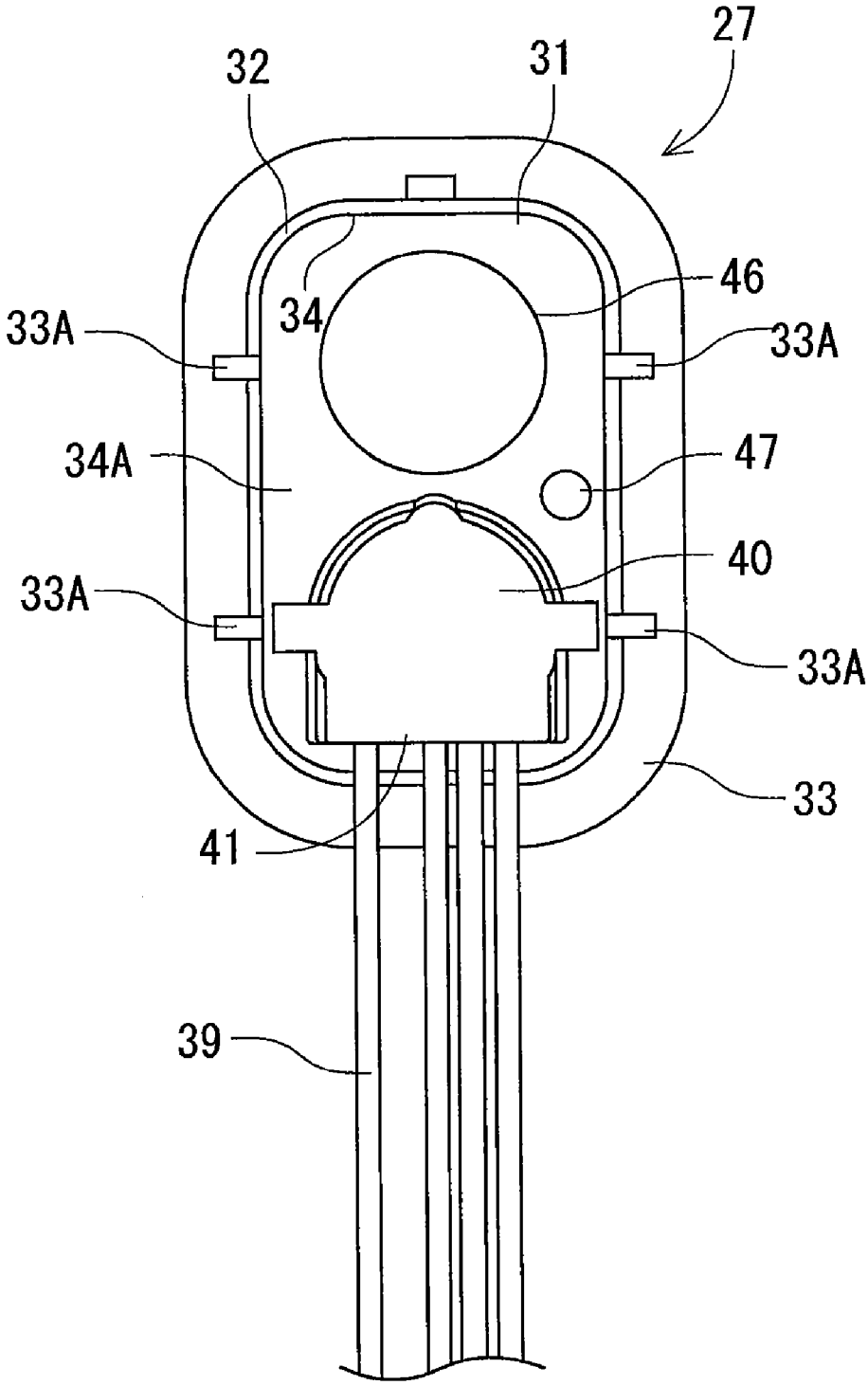
FIG. 4 is a back view of the power socket.
Figure 5:
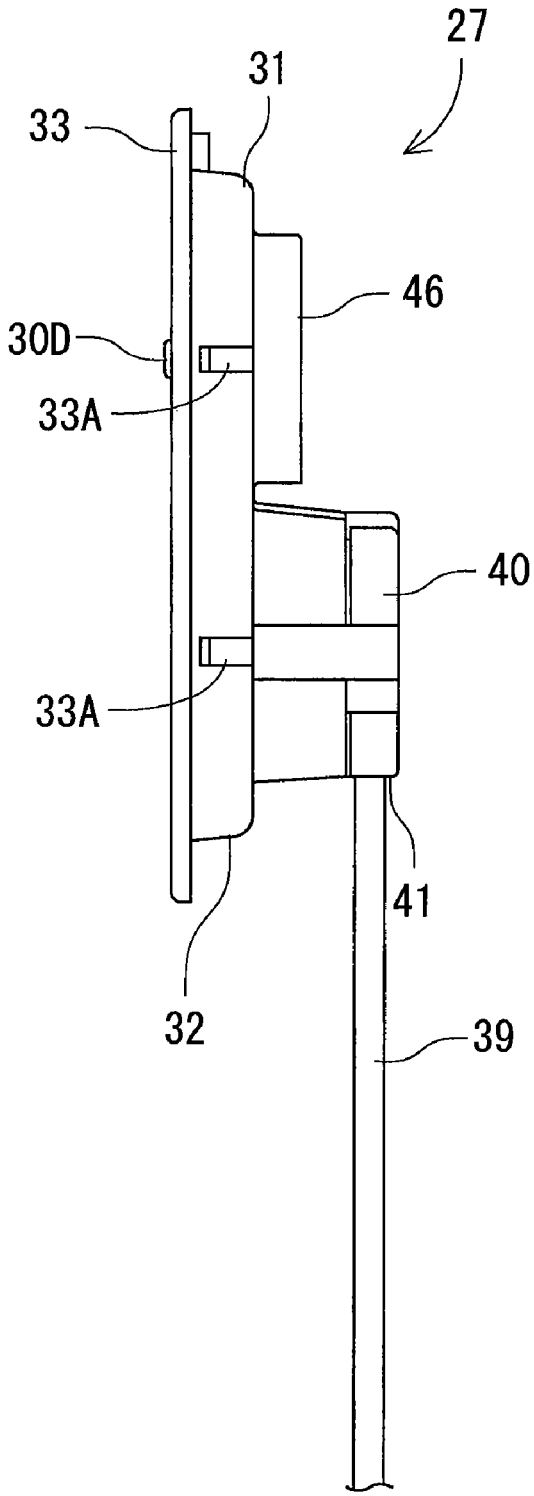
FIG. 5 is a right side view of the power socket.
Figure 7:
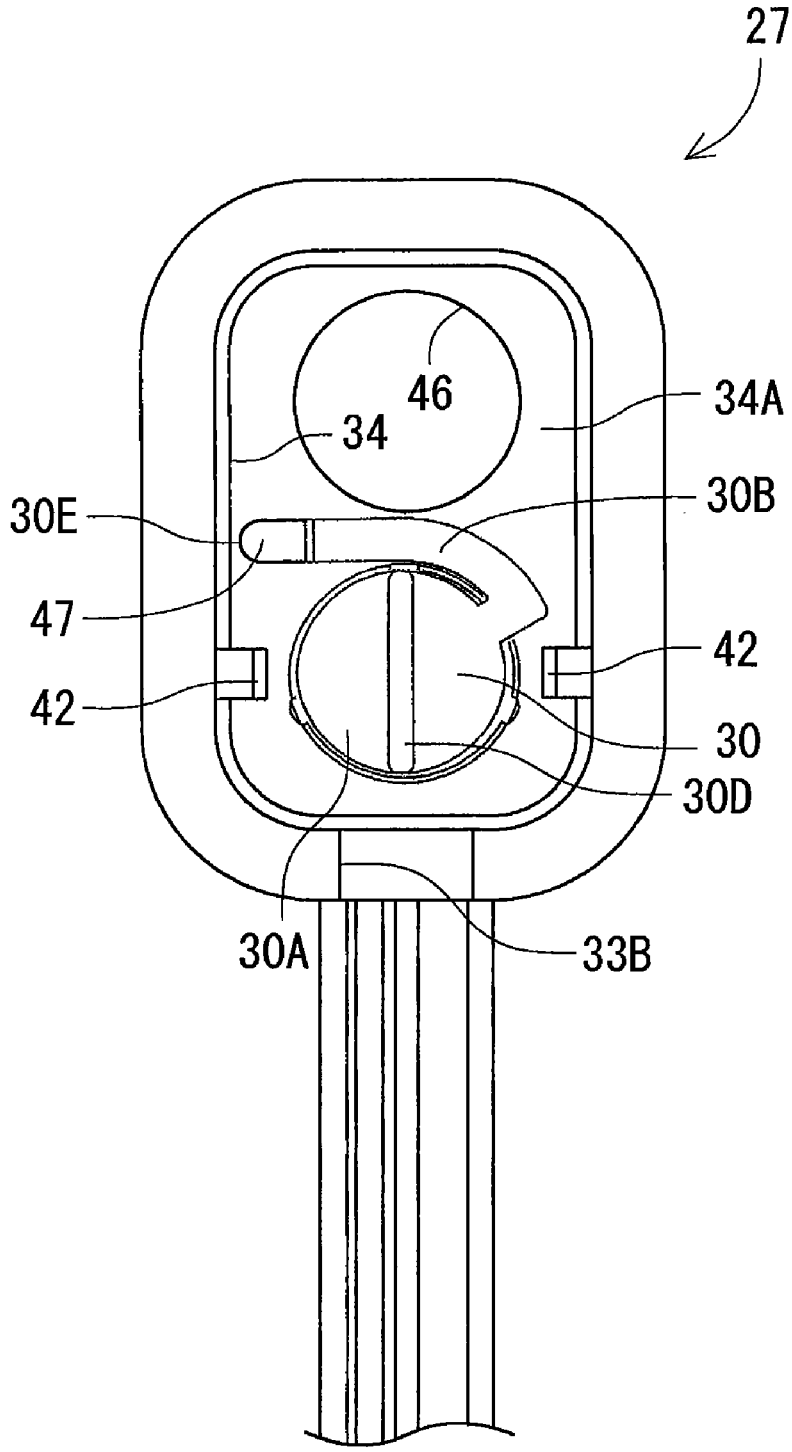
FIG. 7 is a front view of the power socket to which a drip-proof cover is attached.
Figure 8:
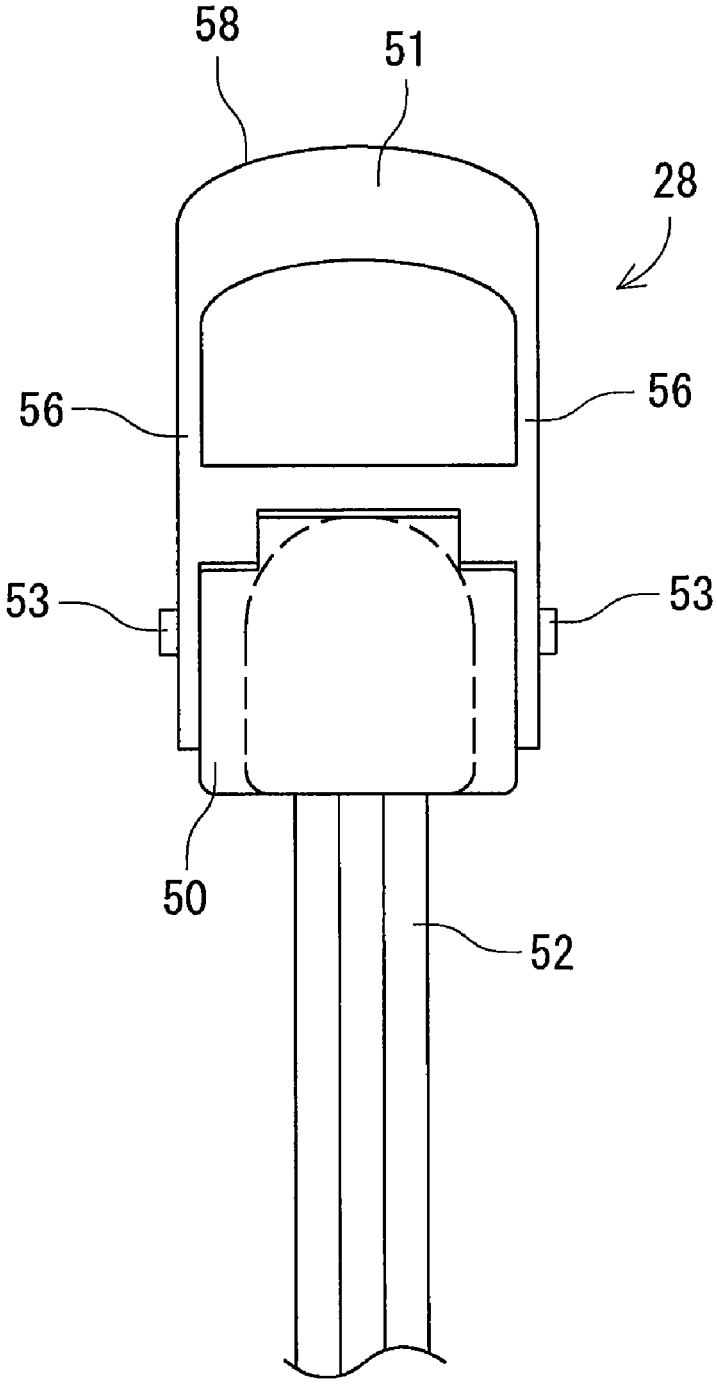
FIG. 8 is a front view of a power plug.
Figure 9:
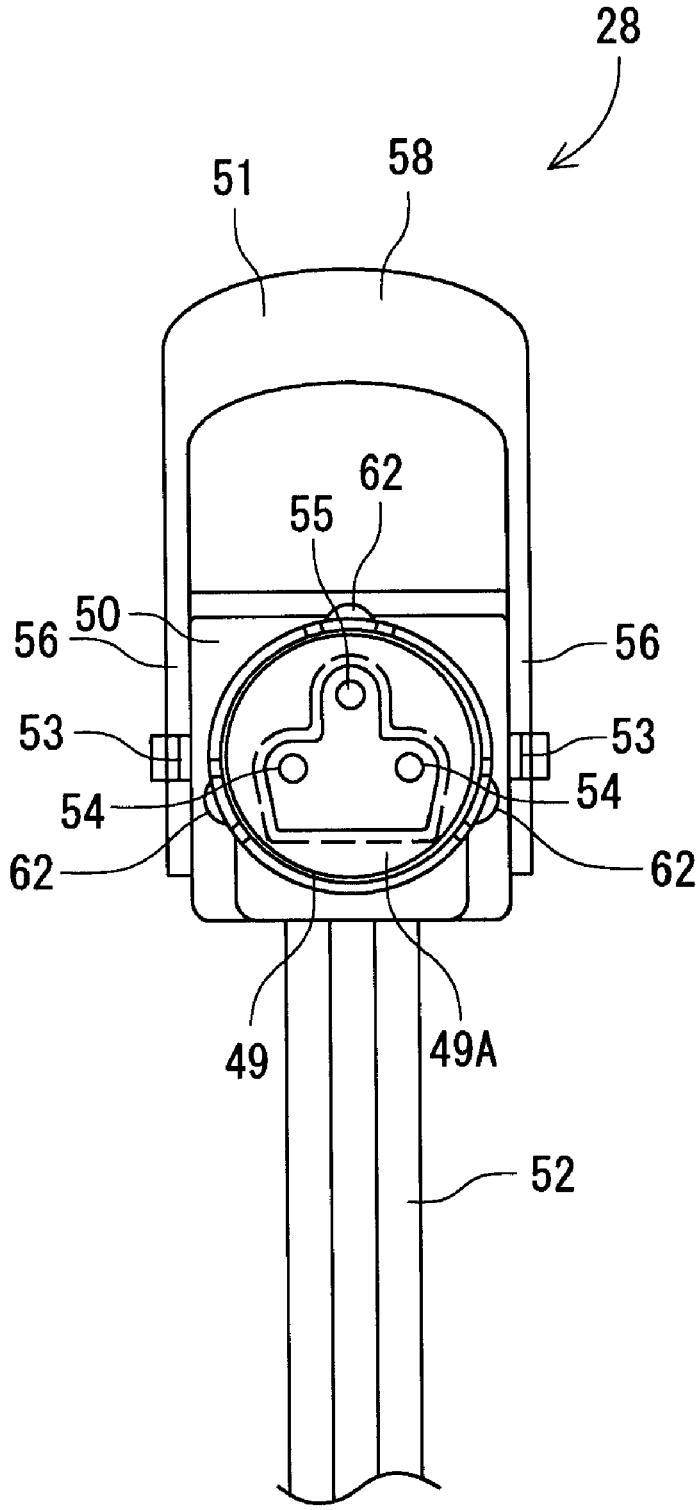
FIG. 9 is a back view of the power plug.
Figure 10:
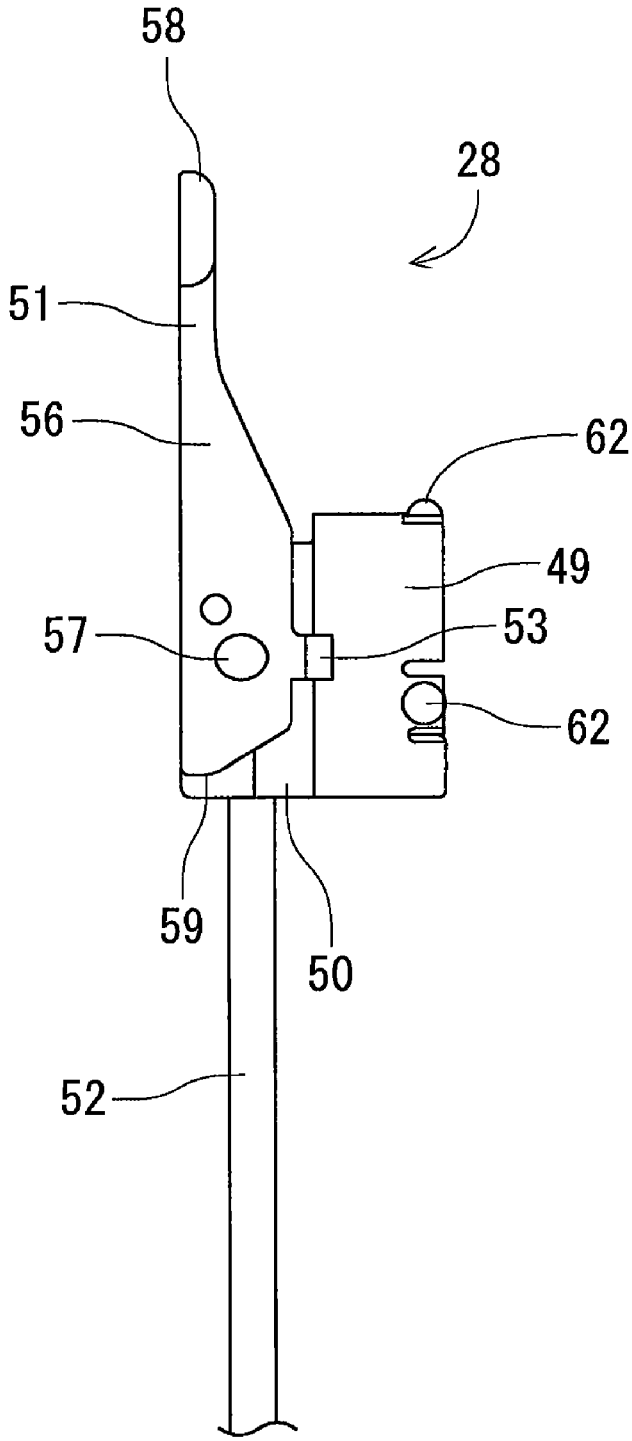
FIG. 10 is a right side view of the power plug (rotated to a power socket side)
Figure 11:
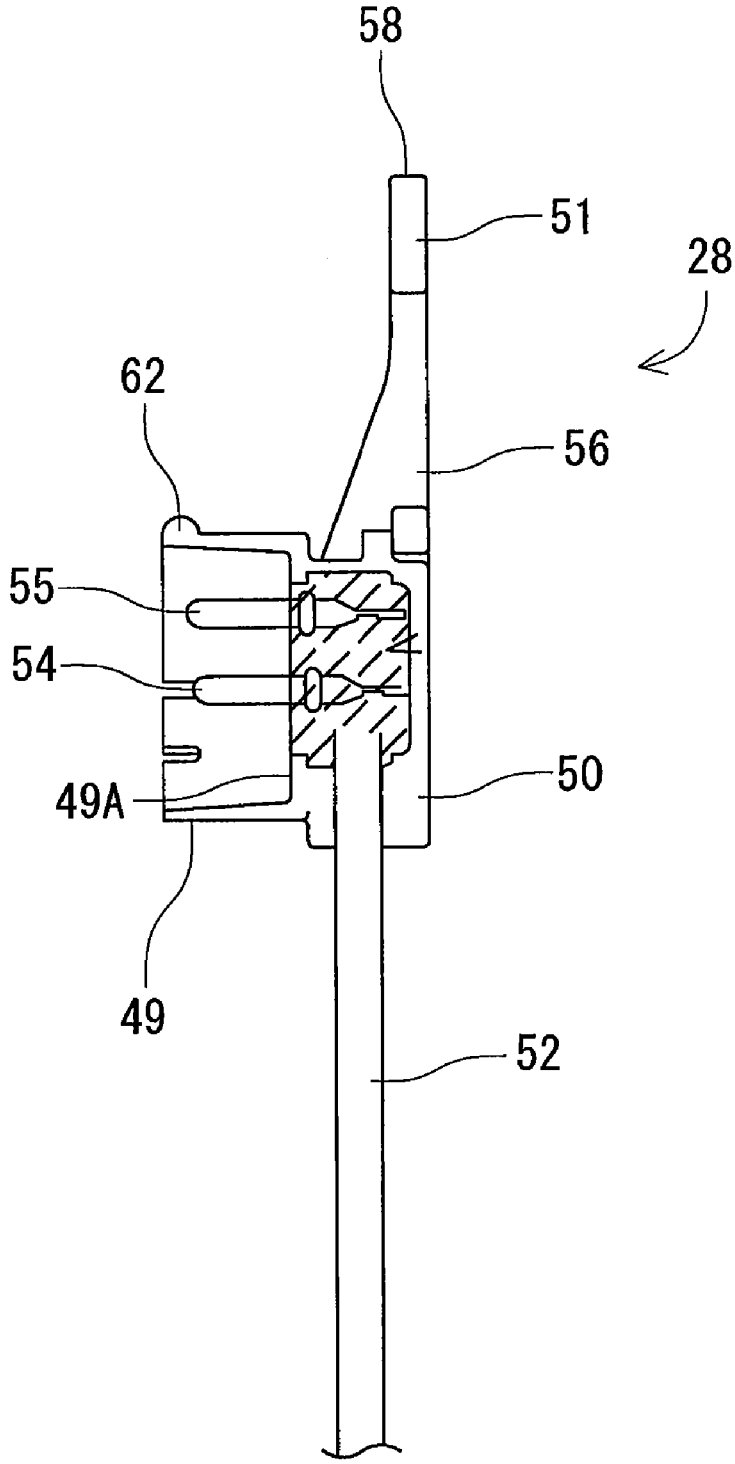
FIG. 11 is a sectional view of the power plug.

Next, a power connection apparatus 25 of the present invention will be described in detail with reference to FIGS. 2 to 13. FIG. 2 shows a front view of the power connection apparatus 25, FIG. 3 shows a front view of a power socket 27, FIG. 4 shows a back view of the power socket 27, FIG. 5 shows a right side view of the power socket 27, FIG. 6 shows a vertical side view of the power socket 27, FIG. 7 shows a front view of the power socket 27 to which a drip-proof cover 30 is attached, FIG. 8 shows a front view of a power plug 28, FIG. 9 shows a back view of the power plug 28, FIG. 10 shows a right side view of the power plug 28 (rotated toward a power socket 27 side), and FIG. 11 shows a sectional view of the power plug 28 (rotated away from the power socket 27), respectively.

The power connection apparatus 25 in the present embodiment is an apparatus for supplying a power to the illuminative lamps 14 and 16 used to illuminate the inside of the display chamber 5 of the low temperature showcase 1 as described above, and the apparatus is constituted of a power socket 27 installed on the partition plate 6 constituting the back surface of the display chamber 5 of the low temperature showcase 1 and a power plug 28 plugged in the power socket 27 to supply the power to the illuminative lamps 14 and 16. In the present embodiment, the power connection apparatus 25 is provided for each of the illuminative lamps 14 and 16, and hence the partition plate 6 is provided with a plurality of vertically arranged power sockets. For example, the number of the power sockets 27 equal to or more than that of the illuminative lamps 14 are provided along a support 64.

Figure 6:
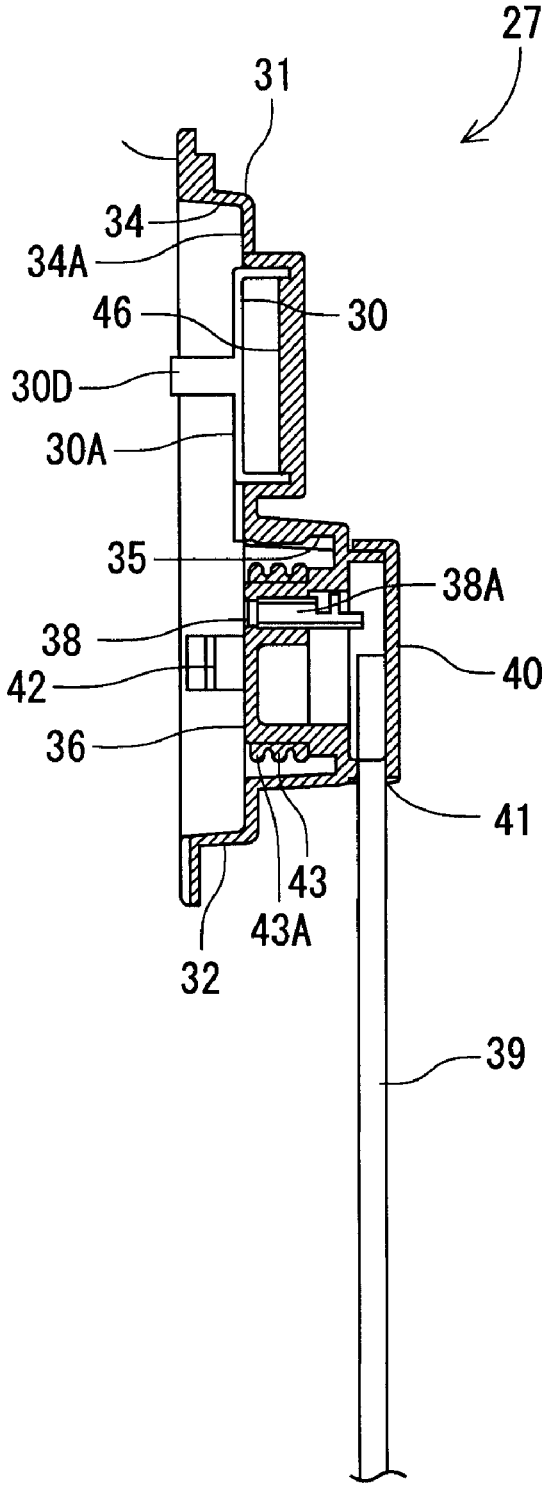
FIG. 6 is a vertical side view of the power socket.

As shown in the sectional view of FIG. 6, the power socket 27 is constituted of a substantially rectangular container-like attachment base 31 made of a hard synthetic resin or the like. An outward flange 33 is formed at the end of an outer peripheral wall 32 constituting the attachment base 31. It is to be noted that in the diagram, reference numeral 33B is a recess portion which receives a lead wire 52 of the power plug 28 connected to an electrode portion 36 described later. Moreover, the outward flange 33 is provided with fixing claws 33A positioned on a side opposite to the connection side of the power plug 28 to hold the partition plate 6 of the showcase 1.

Furthermore, in the attachment base 31, a recess portion 34 is formed inside the outer peripheral wall 32. A bottom 34A of the recess portion 34 is provided with a ring-shaped groove 35, and in the groove 35, an electrode portion 36 projecting to the opening side of the recess portion 34 is formed. It is to be noted that in the depth of the groove 35, engagement portions 63 are depressed to an outer peripheral surface side and formed to be disengageably engaged with engaging claws 62 of the power plug 28 described later.

The electrode portion 36 is provided with two power source plug-in ports 37 and one grounding plug-in port 38. The power source plug-in ports 37 and the grounding plug-in port 38 are provided with corresponding terminal contact portions 38A, respectively (FIG. 6 shows the terminal contact portion 38A provided for the grounding plug-in port 38, but the power source plug-in ports 37 are also provided with the corresponding terminal contact portions), and the terminal contact portions 38A and the like are electrically connected to corresponding lead wires 39 from the side of the bottom 34A of the recess portion 34.

Here, the lead wires 39 connected to the plug-in ports 37 and 38 are drawn to the outside from a lead wire drawing portion 41 formed in the outer peripheral wall 32, and the bottom of the recess portion 34 is closed with a detachably attached closing member 40.

Moreover, a ring-shaped seal member 43 (see sectional views) is attached to the outer peripheral surface of the electrode portion 36. In the present embodiment, the seal member 43 is made of a rubber material, and the outer surface of this member is provided with a plurality of ring-shaped projections 43A . . . arranged with a predetermined space therebetween over a depth direction. In consequence, the power plug 28 connected to the electrode portion 36 or the drip-proof cover 30 can stably be held in a watertight manner as described later in detail.

Furthermore, on the inner surface side of the outer peripheral wall 32 constituting the recess portion 34 of the attachment base 31 of the power socket 27, engagement portions 42 and 42 are formed to be disengageably engaged with engaging claws 53 formed in the power plug 28. Each of the engagement portions 42 projects as much as a predetermined dimension to the inside therefrom with a predetermined space between the engagement portion and the bottom 34A of the recess portion 34. In the present embodiment, the engagement portions 42 are formed at two positions to face each other.

Furthermore, in the bottom 34A of the recess portion 34 of the attachment base 31, a drip-proof cover holding portion 46 substantially circularly depressed to hold the drip-proof cover 30 in the present embodiment is disposed beside (in parallel with) the electrode portion 36. The drip-proof cover 30 is constituted of a cover portion 30A which openably covers the end face of the electrode portion 36 provided with the power source plug-in ports 37 and the grounding plug-in port 38 and a connection arm 30B which connects the cover portion 30A to the attachment base 31 of the power socket 27.

In the present embodiment, the end face of the electrode portion 36 has a substantially round shape, and hence the cover portion 30A is constituted of a substantially round main body which covers the end face of the electrode portion 36 and a side wall formed at the outer periphery of the main body so as to abut on and fit into the side wall of the electrode portion 36. The outer diameter of this side wall is set to a dimension with which the side wall can substantially tightly be held by the drip-proof cover holding portion 46, and the inner diameter thereof is slightly larger than the outer diameter of the electrode portion 36, and is set to a dimension with which the end surface of the electrode portion 36 can substantially tightly be held. In consequence, the cover portion 30A is disengageably engaged with the drip-proof cover holding portion 46 and the electrode portion 36. Moreover, the outer surface of the cover portion 30A is provided with a grasping portion 30D for performing the attachment/detachment operation.

One end (the tip) 30E of the connection arm 30B is rotatably pivotally supported around a rotary shaft 47 by the bottom 34A of the attachment base 31. At this time, the tip 30E of the connection arm 30B is provided in the bottom 34A so as to be positioned with a substantially equal distance from the drip-proof cover holding portion 46 and from the electrode portion 36, respectively.

Moreover, the connection arm 30B projects from a position different from a position where a line connecting the tip 30E pivotally supported by the rotary shaft 47 to the center of the cover portion 30A intersects with the cover portion 30A, and is extended toward the tip 30E. In the present embodiment, the connection arm 30B substantially perpendicularly projects to the outside from a position away from the electrode portion 36 in a state where the cover portion 30A is held by the drip-proof cover holding portion 46, and is then extended toward the tip 30E positioned with the substantially equal distance from the drip-proof cover holding portion 46 and from the electrode portion 36 while curving along the shape of the inner surface of the outer peripheral wall 32 of the attachment base 31.

The connection arm 30B has a predetermined elasticity. The connection arm is extracted to the outside therefrom by manually holding the grasping portion 30D in a state where the cover portion 30A is held by the drip-proof cover holding portion 46 as shown in FIG. 3, whereby the cover portion 30A is detached from the drip-proof cover holding portion 46 via the connection arm 30B owing to the elasticity of the cover portion 30A while keeping a state where the cover portion 30A is attached to the attachment base 31. Subsequently, the connection arm 30B and the cover portion 30A are rotated around the rotary shaft 47 around which the tip 30E of the connection arm 30B is pivotally supported on the electrode portion 36 side, and the cover portion 30A is pressed toward the end face of the electrode portion 36, whereby the cover portion 30A can be fitted into the electrode portion 36 (see FIG. 7). It is to be noted that an operation reverse to the above operation is performed to remove the drip-proof cover 30 from the electrode portion 36.

In consequence, the drip-proof cover 30 can cover the electrode portion 36 in a state where terminals 54 and 55 of the power plug 28 are not connected to the electrode portion 36, which can suppress disadvantages that the electrode portion 36 is exposed to the cold air circulated through a chamber and that dew condensation water invades the inside in a state where the power plug 28 is not connected to the power socket 27.

The drip-proof cover 30 can be held by the drip-proof cover holding portion 46 formed in the attachment base 31, and hence even when the power plug 28 is connected to the power socket 27 and used, it is not necessary to separately store the only drip-proof cover 30, and it is possible to avoid a disadvantage that the drip-proof cover 30 is lost.

Moreover, since the cover portion 30A is provided with the connection arm 30B as described above, the cover portion 30A can only move along the minimum track while keeping the state where the cover portion is attached to the attachment base 31 via the connection arm 30B, to realize the fitting into the electrode portion 36 and the holding by the drip-proof cover holding portion 46. In this case, the attachment/detachment operation to/from the electrode portion 36 and the drip-proof cover holding portion 46 involves an outwardly extracting operation. However, in the present embodiment, as to the connection arm 30B connecting the cover portion 30A to the attachment base 31, the length of the connection arm 30B can further be increased in the limited space of the attachment base 31, and the length required during the attachment/detachment to/from the electrode portion 36 or the drip-proof cover holding portion 46 can be achieved by the elasticity of the connection arm.

In consequence, it is possible to improve the attachment/detachment operation properties of the drip-proof cover 30 to/from the electrode portion 36 and the drip-proof cover holding portion 46 while preferably pivotally supporting the drip-proof cover 30 by the attachment base 31 of the power socket 27.

Next, the power plug 28 connected to the electrode portion 36 of the power socket 27 will be described. The power plug 28 comprises a main body 50 and a cylindrical portion 49 formed of a synthetic resin or the like, and the handle 51 rotatably provided in the main body 50.

A bottom 49A positioned inside the cylindrical portion 49 is provided with two power source terminals 54 and one grounding terminal 55 as shown in FIG. 9, and the terminals 54 and the like are received in the cylindrical portion 49. The power source terminals 54 and the grounding terminal 55 are electrically connected to the illuminative lamps 14 and 16 attached to the inside of the display chamber 5 via the lead wires 52.

Furthermore, on the side of the end face of the cylindrical portion 49 (the power socket 27 side), a plurality of engaging claws 62 are formed with a predetermined space therebetween. The engaging claws 62 are formed with a predetermined elasticity so as to project to the outside therefrom, and are substantially tightly engaged with the engagement portions 63 of the power socket 27 owing to the elasticity of the claws in a state where the claws are received in the groove 35 of the power socket 27.

Moreover, the handle 51 is rotatably provided at the end of the outer surface of the main body 50 of the power plug 28. That is, as shown in FIG. 8, the handle 51 is positioned on the surface of the power plug 28 opposite to the cylindrical portion 49 of the main body 50 of the power plug (the terminals 54 and 55), and arm portions 56 and 56 provided at both side portions of the main body are rotatably pivotally supported by rotary shafts 57 and 57 projecting to the outside from both side surfaces of the main body 50.

In FIG. 10, the power plug 28 is seen from the side of the main body 50. In the present embodiment, each of the arm portions 56 includes a grip portion 58 on the side of connection between both the arm portions 56 and 56 (at one end) and the abutment portion 59 at the end positioned on the lead wire 52 side (at the other end). Moreover, a pivoting portion (a rotation hole) 60 is formed so as to be positioned between the grip portion 58 and the abutment portion 59, to rotatably pivotally support the rotary shaft 57 of the main body 50.

Here, as to the other end of each of the arm portions 56, the side surface of the end positioned on the power socket 27 side in a state where the engaging claws 53 of the power plug 28 engage with the engagement portions 42 of the power socket 27 is an inclined face 59A cut out from the power socket 27 side to the outside thereof (the side opposite to the power socket 27), and the end face positioned on a side opposite to the power socket 27 side is the abutment portion 59 which abuts on the bottom 34A of the recess portion 34 of the power socket 27 during the attachment/detachment operation by the operation of the handle 51.

Furthermore, the abutment portion 59 is shorter as much as a predetermined dimension from the end face of the cylindrical portion 49 in a state where the handle 51 is rotated to substantially form right angles with respect to the power socket 27, and the dimension thereof is set so that the terminals 54 and 55 of the power plug 28 do not come in contact with the terminal contact portions 38A of the electrode portion 36 and the like, when the handle is pressed onto the electrode portion 36 of the power socket 27 in this state.

Moreover, the end faces of the arm portions 56 on the cylindrical portion 49 side are provided with the outward engaging claws 53 which are positioned at the pivoting portion 60 to project to the cylindrical portion 49 side and the power socket 27 side. The engaging claws 53 are engaging portions which can disengageably be engaged with the engagement portions 42 of the power socket 27 as described above. It is to be noted that positions where the engaging claws 53 are formed are not limited to this example, and each engaging claw may be positioned on the grip portion 58 side from the pivoting portion 60.

According to the above constitution, when the power socket 27 is attached to the partition plate 6 as described above, the power socket 27 is attached to a socket hole (not shown) beforehand formed in the partition plate 6 so as to project from the display chamber 5 side to the cold air duct 9 side, and the partition plate 6 is held by the fixing claws 33A and the outward flange 33 of the power socket 27, to fix the power socket 27 to the partition plate 6. In consequence, the opening side of the attachment base 31 of the power socket 27, i.e., the power plug 28 on the connection side is positioned on the display chamber 5 side, and the recess portion 34 on the bottom 34A side is positioned on the cold air duct 9 side.

Figure 13:
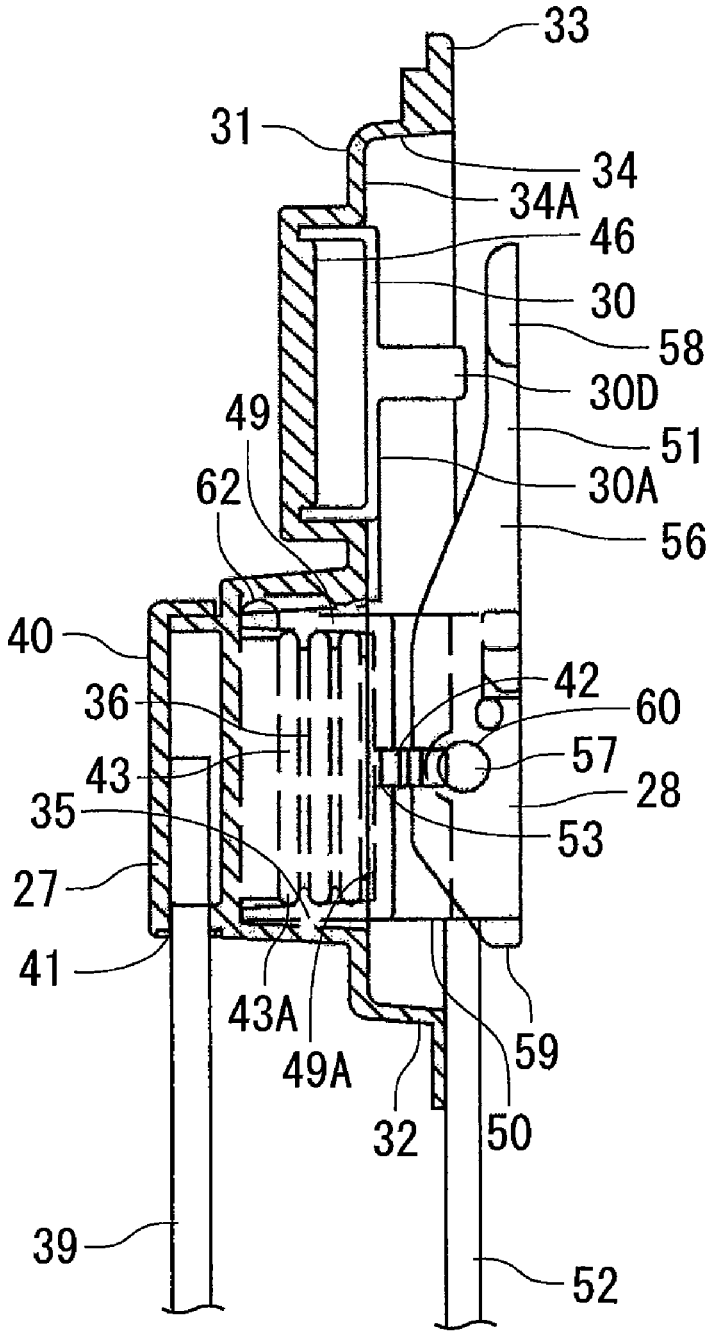
FIG. 13 is an explanatory view of the connection state between the power plug and the power socket.
Figure 14:
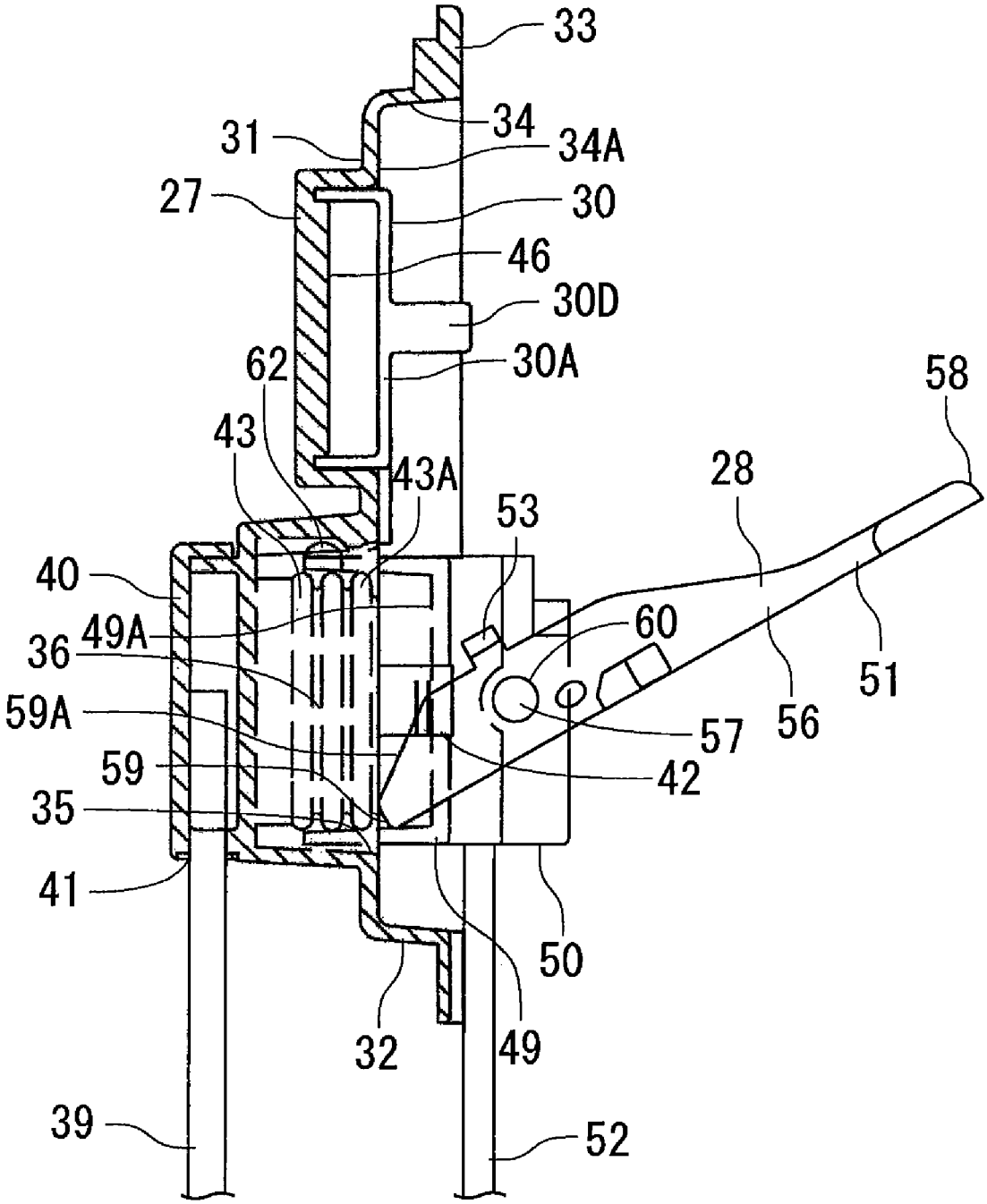
FIG. 14 is an explanatory view of the connection state between the power plug and the power socket.

Next, an operation of attaching/detaching the power plug 28 to/from the electrode portion 36 of the power socket 27 will be described with reference to the above diagrams and additionally with reference to FIGS. 12 to 14 which are diagrams for explaining a connection state between the power plug 28 and the power socket 27. First, the connecting of the power plug 28 to the electrode portion 36 of the power socket 27 will be described. When the electrode portion 36 is covered with the drip-proof cover 30, the drip-proof cover 30 is removed from the electrode portion 36 to expose the electrode portion 36.

Figure 12:
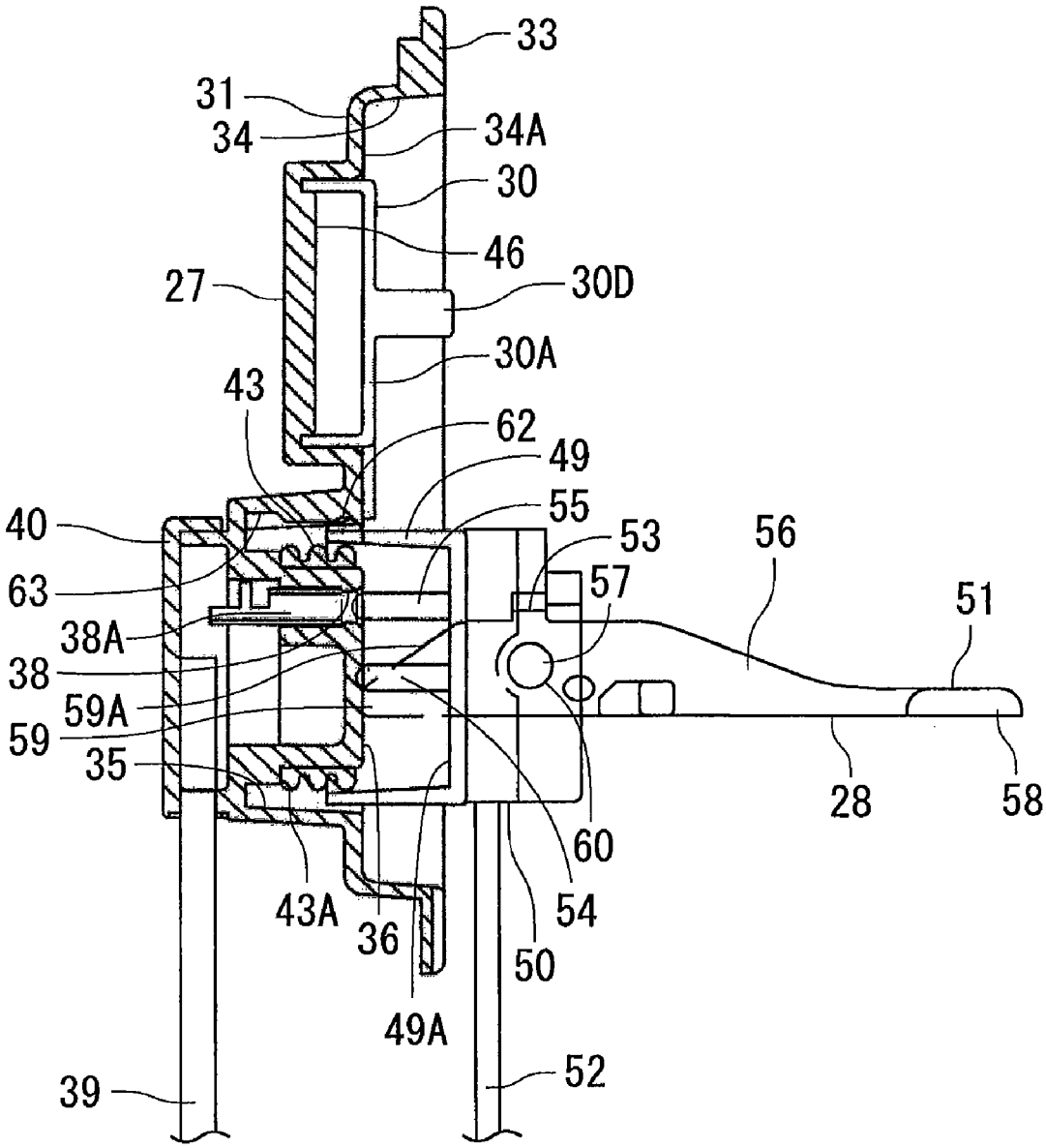
FIG. 12 is an explanatory view of a connection state between the power plug and the power socket.

Subsequently, the handle 51 of the power plug 28 is rotated around the pivoting portion 60 to obtain a state where as shown in FIG. 12, the grip portion 58 tilts to the side opposite to the power socket 27 and the abutment portion 59 projects to the power socket 27 side. In this case, while the grip portion 58 of the handle 51 is rotated to obtain an angle (a second angle with respect to a first angle described later) at which the grip portion is at substantially right angles to the power socket 27, the cylindrical portion 49 of the power plug 28 is brought close to the electrode portion 36 of the power socket 27.

In consequence, the abutment portion 59 of the handle 51 on the power plug 28 side abuts on the bottom 34A of the recess portion 34 of the power socket 27 substantially at right angles. As described above, the abutment portion 59 is formed to be shorter as much as the predetermined dimension from the end face of the cylindrical portion 49, and hence the electrode portion 36 slightly enters the cylindrical portion 49. Consequently, the end of the cylindrical portion 49 is held by the seal member 43 and the engaging claws 62 having the elasticity at the inlet portion of the groove 35 formed in the outer periphery of the electrode portion 36, and the cylindrical portion 49 is tentatively held in the inlet portion of the groove 35.

The tentative holding of the cylindrical portion 49 can be realized by fitting the cylindrical portion into the seal member 43 provided around the electrode portion 36, and hence the power plug 28 can tentatively be held by the power socket 27 with a simple constitution. Moreover, a waterproof structure can be constituted, and it is possible to avoid a disadvantage that water sticks to the inside of the electrode portion 36 and the terminals 54 and 55.

In this state, as shown in FIG. 12, the terminals 54 and 55 on the power plug 28 side enter inlet portions of the plug-in ports 37 and 38 of the electrode portion 36, but a space is formed between each terminal and each of the terminal contact portions 38A provided in the ports or the like, and the terminals do not come in contact with the portions.

In consequence, in the process of connecting the power plug 28 to the power socket 27, the plug is tentatively held in this manner, which can improve connecting operation properties. Moreover, when the connecting operation of the power plug 28 and the power socket 27 is discontinued in this state, the terminals 54 and 55 and the terminal contact portions 38A of the electrode portion 36 or the like are left in a non-contact state, and the illuminative lamps 14 and 16 are not lit, which allows an operator to recognize that the connection is not sufficient.

Afterward, the grip portion 58 of the handle 51 is slightly rotated in such a direction as to come close to the power socket 27, and a portion which comes in contact with the bottom 34A of the recess portion 34 of the power socket 27 is moved from the abutment portion 59. Subsequently, the power plug 28 is pressed onto the power socket 27 in a direction in which the terminals 54 and 55 of the power plug 28 are connected to the electrode portion 36 of the power socket 27, whereby the engaging claws 62 of the cylindrical portion 49 of the power plug 28 are engaged with the engagement portions 63 on the power socket 27 side (FIG. 13). By the pressing operation (the connecting operation), the terminals 54 and 55 of the power plug 28 are electrically connected to the terminal contact portions 38A provided in the plug-in ports 37 and 38 or the like.

The grip portion 58 of the handle 51 is rotated to the power socket 27 side in this state, whereby the engaging claws 53 and 53 formed in the handle 51 are engaged with the engagement portions 42 and 42 formed on the power socket 27 side.

In consequence, the terminals 54 and 55 can securely be connected to the electrode portion 36 to secure the engagement between the engaging claws 53 and the engagement portions 42 by the rotation of the handle 51, and it is possible to beforehand avoid a disadvantage that the power plug 28 drops down from the power socket 27 owing to, for example, the growth of the frost between the power plug 28 and the power socket 27 or the like.

When the power plug 28 is connected to the power socket 27 provided on the partition plate 6 at the back surface of the low temperature showcase 1, there is a predetermined distance from the operator to the attachment position of the power socket 27, whereby the grip portion 58 of the handle 51 of the power plug 28 is usually grasped in a state where the grip portion is rotated substantially by 90° in such a direction as to come away from the power socket 27 (the front side). When the power plug 28 is pressed onto the power socket 27 at such an angle that the power plug is at substantially right angles to the power socket 27 in this state, the end of the cylindrical portion 49 is tentatively held by the groove 35 around the electrode portion 36 as described above.

As described above, the space is formed between each of the terminal contact portions 38A of the electrode portion 36 or the like and each of the terminals 54 and 55 of the power plug 28, and the terminal contact portions and the like do not come in contact with the terminals. Therefore, the illuminative lamp 16 or the like is not lit, which can urge the operator to push the power plug 28 into the power socket 27 and to rotate the handle 51 until the handle is substantially raised (in such a direction as to come close to the power socket 27 side), thereby engaging the engaging claws 53 of the power plug 28 with the engagement portions 42 of the power socket 27.

This can secure the connection state between the power plug 28 and the power socket 27, and the incurring of the electrical leakage or the rusting of the terminals or the like can be eliminated.

On the other hand, when the power plug 28 is detached from the power socket 27, the operator rotates the grip portion 58 formed in the handle 51 of the power plug 28 in the direction in which the grip portion comes away from the power socket 27. In consequence, the pivoting portion 60 of the handle 51 is rotated as much as a predetermined angle, i.e., the second angle smaller than the above first angle in this case around the rotary shaft 57 of the main body 50 to first release the engagement between the engaging claws 53 of the power plug 28 and the engagement portions 42 of the power socket 27.

Subsequently, the grip portion 58 is further rotated in such a direction as to come away from the power socket 27, and the inclined face 59A of the handle 51 rotated in such a direction as to come close to the power socket 27 abuts on the bottom 34A of the recess portion of the power socket 27. The inclined face 59A of the abutment portion 59 slides along the bottom 34A of the recess portion (see FIG. 14), whereby a force is added in a direction in which the terminals 54 and 55 (the cylindrical portion 49 which has entered the groove 35) are detached from the electrode portion 36 of the power socket 27 by the principle of leverage, to release the electric connection between the electrode portion 36 and the terminals 54 and 55 and to release the engagement between the power plug 28 and the power socket 27. In this case, while the handle 51 is rotated to such an angle that the handle is at substantially right angles to the power socket 27, i.e., the second angle, the abutment portion 59 abuts on the power socket 27, thereby releasing the connection between the electrode portion 36 and the terminals 54 or the like.

Therefore, even when the joining between the electrode portion 36 and the cylindrical portion 49 of the power plug 28 by the seal member 43 is strengthened by the use thereof in a low temperature atmosphere, the power plug 28 can smoothly and easily be inserted into and detached from the power socket 27 by use of a small force for rotating the grip portion 58 away from the power socket 27 owing to the principle of leverage. In consequence, the deformation of the terminals 54 and 55 and the like can be prevented in advance.

In this way, the connection between the power plug 28 and the power socket 27 in the present embodiment can be secured by the engagement between the engaging claws 53 and the engagement portions 42, and the improvement of the connecting operation properties and removal operation properties can be achieved.

It is to be noted that in the power plug 28 of the present embodiment, in a state where the grip portion 58 of the handle 51 is rotated to the power socket 27 side, i.e., when the abutment portion 59 of the handle 51 does not project to the power socket 27 side and the cylindrical portion 49 of the power plug 28 is pressed onto the electrode portion 36 of the power socket 27, the engaging claws 53 on the power plug 28 side and the engagement portions 42 on the power socket 27 side, which are made of a material having a predetermined elasticity, are deformed by a force for pushing the power plug 28 into the power socket 27, whereby the engaging claws 53 ride over the engagement portions 42, thereby engaging the engaging claws 53 with the engagement portions 42.

In consequence, the power plug 28 is not influenced by the rotating position of the handle 51, but the power plug 28 can smoothly be attached to and detached from the power socket 27, and the improvement of the convenience can be achieved.

What is claimed is:

1. A power connection apparatus which is constituted of a power socket including an electrode portion and a power plug including terminals electrically connected to the electrode portion, the apparatus comprising:

an engagement portion formed in the power socket; and a handle including a grip portion at one end thereof and an abutment portion at the other end, a pivoting portion positioned between the ends being rotatably attached to the power plug, wherein the handle includes engaging claw positioned at the pivoting portion or on the side of the grip portion from the pivoting portion to be disengageably engaged with the engagement portion of the power socket, when the handle is rotated in a direction in which the grip portion comes close to the power socket in a state where the terminals of the power plug are connected to the electrode portion of the power socket, the engaging claw disengageably engages with the engagement portion, when the handle is rotated as much as a predetermined angle or more from the state in a direction in which the grip portion comes away from the power socket, the engagement between the engaging claw and the engagement portion is released, and when the handle is further rotated to such an angle that the handle is at substantially right angles to the power socket, the abutment portion abuts on the power socket to release the connection between the electrode portion and the terminals such that there is no physically-direct contact therebetween, wherein when the power plug is pressed onto the power socket in such a direction as to connect the terminals to the electrode portion in the state where the handle is rotated to such an angle that the handle is at substantially right angles to the power socket, and wherein the power plug fits into a seal member provided around the electrode portion, the seal member tentatively holding the power plug in a state where the electrode portion is neither electrically nor physically connected to the terminals.

2. The power connection apparatus according to claim 1, wherein the engaging claw can be disengageably engaged with the engagement portion, even when the power plug is pressed onto the power socket in such a direction as to connect the terminals to the electrode portion in a state where the engaging claw is directed to the power socket.

3. The power connection apparatus according to claim 1, wherein the power socket comprises a drip-proof cover which covers the electrode portion in a state where the terminals of the power plug are not connected to the electrode portion.

4. The power connection apparatus according to claim 3, wherein the power socket comprises a holding portion disposed beside the electrode portion to detachably hold the drip-proof cover, the drip-proof cover comprises a connection arm extended with an elasticity and having a tip rotatably supported by the power socket, and the connection arm projects from a position different from a position where a line connecting the tip to the center of the drip-proof cover intersects with the drip-proof cover, and extends toward the tip thereof.

* * * * *